United States Patent [19]

Natchev

[11] Patent Number: 4,518,060

[45] Date of Patent: May 21, 1985

[54] SUPPORT FOR HAND AND KNEE AT WORK ON LOW LEVEL

[76] Inventor: Emil Natchev, Upplandsgatan 50, Stockholm, Sweden

[21] Appl. No.: 479,180

[22] Filed: Mar. 28, 1983

[30] Foreign Application Priority Data

Sep. 8, 1982 [SE] Sweden ..... 822145

[51] Int. Cl.[3] ..... A47C 9/00

[52] U.S. Cl. ..... 182/230; 297/439

[58] Field of Search ..... 297/439, 183, 423; 182/230; 5/443

[56] References Cited

U.S. PATENT DOCUMENTS

| | | | |
|---|---|---|---|
| D. 262,911 | 2/1982 | Weddell | 5/443 |
| 1,362,692 | 12/1920 | Goldstein | 297/439 |
| 2,225,696 | 12/1940 | Holzderber | 182/230 |
| 3,141,701 | 7/1964 | Wilkins | 297/439 |
| 4,090,268 | 5/1978 | Turner | 5/443 |

*Primary Examiner*—Francis K. Zugel

*Attorney, Agent, or Firm*—Larson and Taylor

[57] ABSTRACT

A hassock-like arrangement with steps is utilized to support a worker's knee at low level. The support comprises a vertical substantially triangular member having a sloping upper side of wave shape forming the steps. Preferably the steps are lined with soft material. Close to the highest step a support for the hand is provided for use when rising from a kneeling position.

3 Claims, 4 Drawing Figures

SUPPORT FOR HAND AND KNEE AT WORK ON LOW LEVEL

Figure 1:
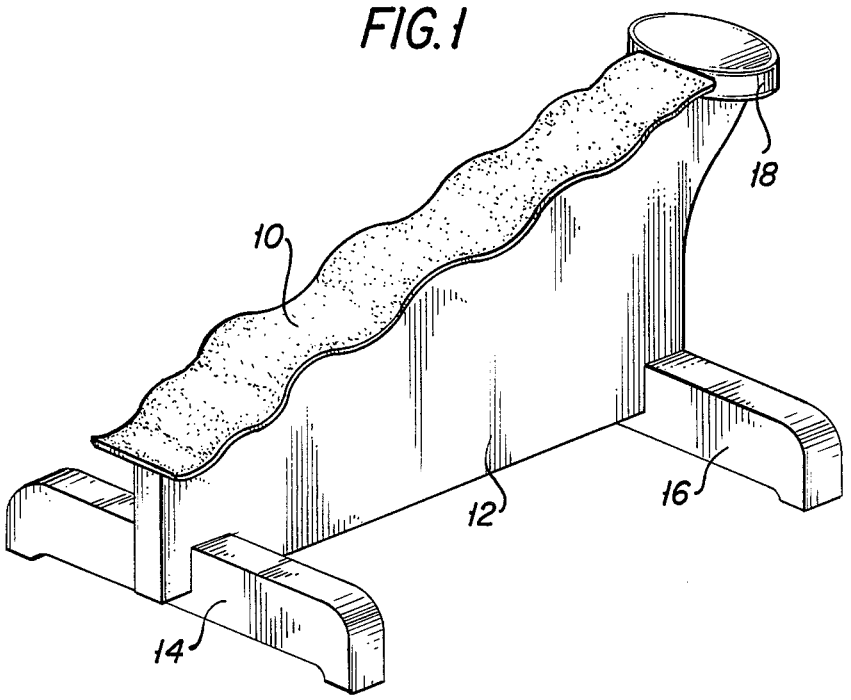

At work on low level, for instance scouring a floor or at other cleaning one had hitherto to lean deeply, and it has thereby been proved that damages rather easily will arise in the muscles or even in the spinal cord. Even if no such damage should occur the person concerned will soon be tired. One has tried to obviate ths disadvantage by supporting the knees on some support placed on the floor such as a folded cloth or the like but this has also not proved satisfactory, because the person concerned will thereby have his knees at a low level, so that it will be difficult to stretch the arms sufficiently out, and, further it may be difficult to rise up from said low level.

The present design refers to a support arrangement for hand and knee at work on low level by which said disadvantages are avoided and further advantages are gained. Amongst such disadvantages the following may be mentioned: If the support arrangement was made in such a way that it would only allow for resting the knee onto a support of a given height, this would certainly suit persons of a given size but the support arrangement would be too high for persons of a considerably smaller size and also too low for persons of a considerably larger body size. Further, in order to rise in a comfortable way, one will need some possibility to rest the hand onto a support which is at least as high as the highest knee support concerned and preferably a little higher.

This design concerns a hassock-like arrangement with steps in continuous sequence after each other, so that some steps will be situated at a lower height and other ones at a higher height above the floor. Preferably, these steps are lined by some soft material, such as rubber cloth. They are intended to support the knee at work on low level. Close to the highest step of this type, a support for the hand is provided intended for instance to be used when rising up from a kneeling position.

The design is more closely shown in the form of two embodiments in the attached drawings. However, it is understood that the design shall not be limited to these two embodiments, but that all different modifications may occur within the frame of the protection.

Figure 2:
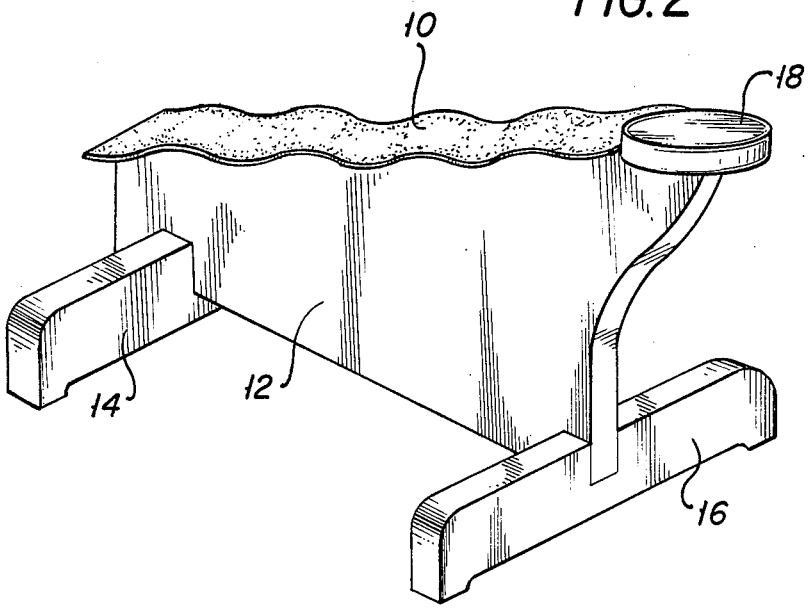

In the drawings,

FIG. 1 shows a first embodiment of the design seen in an inclined direction onto the end where the lowermost step is arranged, whereas FIG. 2 shows same design from behind or with other words from the end, where the hand support is situated.

Figure 4:
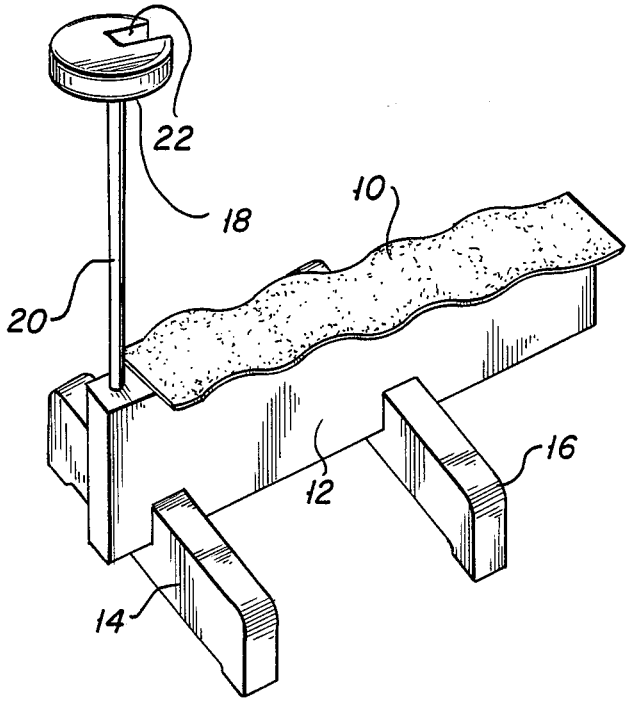
Figure 3:
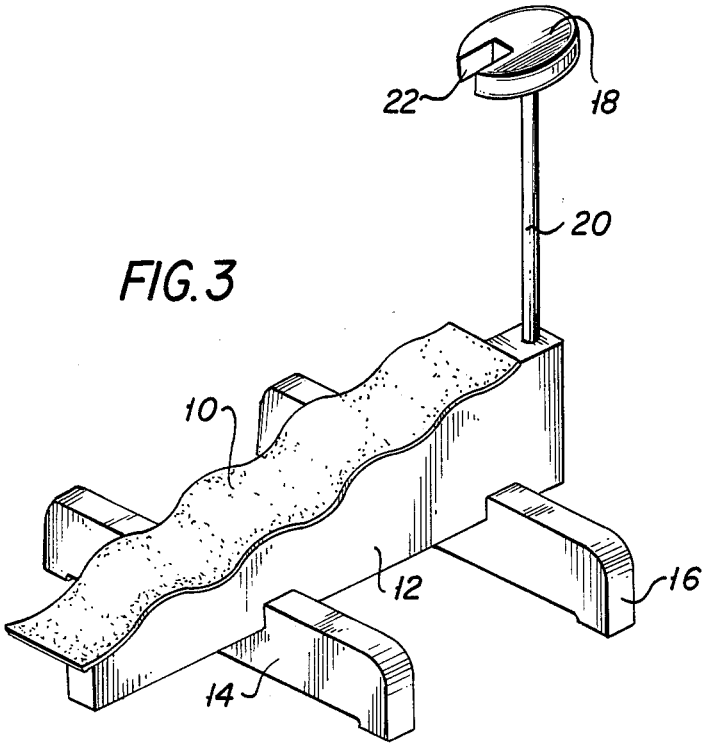

FIGS. 3 and 4, in a corresponding way, show a second embodiment of the design.

In the support device according to FIG. 1 and 2, the soft liner 10 for supporting the knee is applied on a substantially triangular vertical disc 12 having feet 14 and 16 which extend outwardly on both sides of the disc 12. On its upper sloping side the disc 12 is shaped in waveform so that a corresponding wave form will exist in the soft liner 10. At the upper end of the waveformed side, a preferably round disc 18 is attached, serving for hand support.

In FIGS. 3 and 4 same reference numerals have been used for corresponding parts. In this case, however, the rounded disc 18 has been mounted on an upwardly extending staff 20 and has been provided with a recess 22, intende to receive one or more fingers of the person resting his hand on the disc 18.

When using this support, the person concerned may rest his knee onto some wave-trough of the soft liner 10 at a height which is comfortable with respect to the size of of the person concerned and he may rest his hand on the disc 18, if he finds it suitable, simultaneously as working with the other hand. When the person concerned has to rise up from this low position, this will be very easy done by gripping with the hand over the round disc 18.

I claim:

1. A support for hand and knee to be used when working at low level, comprising a vertical, substantially triangular disc (12) having a sloping upper side of wave shape, a soft liner (10) preferably from rubber cloth, which is attached to said upper side of said disc (12), and feet (14, 16) associated with the bottom side of said disc (12) and directed perpendicularily to said disc (12) for carrying said disc in a vertical position, and, at the uppermost end of said disc (12) a rest disc (18) for the hand at same level or at a higher level than the uppermost part of the soft liner (10).

2. A support according to claim 1, in which said rest disc (18) is carried up by means of a vertical staff (20) connected to said first mentioned disc (12).

3. A support according to claim 2, in which said rest disc (20) comprises a recess at its periphery (22) adapted to one or more fingers for making it more easy to grip the said rest disc by the hand.

* * * * *